US007178186B2

(12) United States Patent
Harris

(10) Patent No.: US 7,178,186 B2
(45) Date of Patent: Feb. 20, 2007

(54) INFLATABLE SUPPORT APPARATUS

(75) Inventor: Stuart Harris, Cornwall (GB)

(73) Assignee: Spin Master Ltd., Toronto (CA)

( * ) Notice: Subject to any disclaimer, the term of this patent is extended or adjusted under 35 U.S.C. 154(b) by 0 days.

(21) Appl. No.: 11/175,064

(22) Filed: Jul. 5, 2005

(65) Prior Publication Data

US 2006/0010606 A1 Jan. 19, 2006

(30) Foreign Application Priority Data

Jul. 6, 2004 (GB) ..... 0415136

(51) Int. Cl.
*A47D 13/00* (2006.01)
*A47C 27/10* (2006.01)

(52) U.S. Cl. ..... 5/655; 5/53.1; 5/691; 5/732; 5/710

(58) Field of Classification Search ..... 5/731–733, 5/691, 706, 710, 419, 420, 655, 53.1
See application file for complete search history.

(56) References Cited

U.S. PATENT DOCUMENTS

| | | | | | |
|---|---|---|---|---|---|
| 1,576,211 | A * | 3/1926 | O'Kane | ..... | 5/710 |
| 2,672,628 | A * | 3/1954 | Spanel | ..... | 5/655 |
| 3,740,095 | A * | 6/1973 | Nail | ..... | 297/454 |
| 3,761,975 | A * | 10/1973 | Personett | ..... | 5/655 |
| 4,744,112 | A * | 5/1988 | Keesling, Jr. | ..... | 4/585 |
| 4,964,183 | A * | 10/1990 | LaForce, Jr. | ..... | 5/421 |
| 5,075,910 | A * | 12/1991 | Morten | ..... | 5/53.1 |
| 5,341,530 | A * | 8/1994 | Ward | ..... | 5/93.1 |
| 5,699,569 | A * | 12/1997 | Schwarz-Zohrer | ..... | 5/655 |
| 6,393,639 | B1 * | 5/2002 | Ohsner | ..... | 5/425 |
| 6,848,128 | B2 * | 2/2005 | Verbovszky et al. | ..... | 5/93.1 |

* cited by examiner

*Primary Examiner*—Michael Trettel
(74) *Attorney, Agent, or Firm*—Cohen Pontani Lieberman & Pavane LLP

(57) ABSTRACT

An inflatable mattress with an inflatable headboard and/or footboard. Inflatable side supports may also be included. The mattress is particularly suited for infants or toddlers in that the side and end supports prevent a child from rolling or sliding off the mattress.

16 Claims, 2 Drawing Sheets

INFLATABLE SUPPORT APPARATUS

Figure 1A:
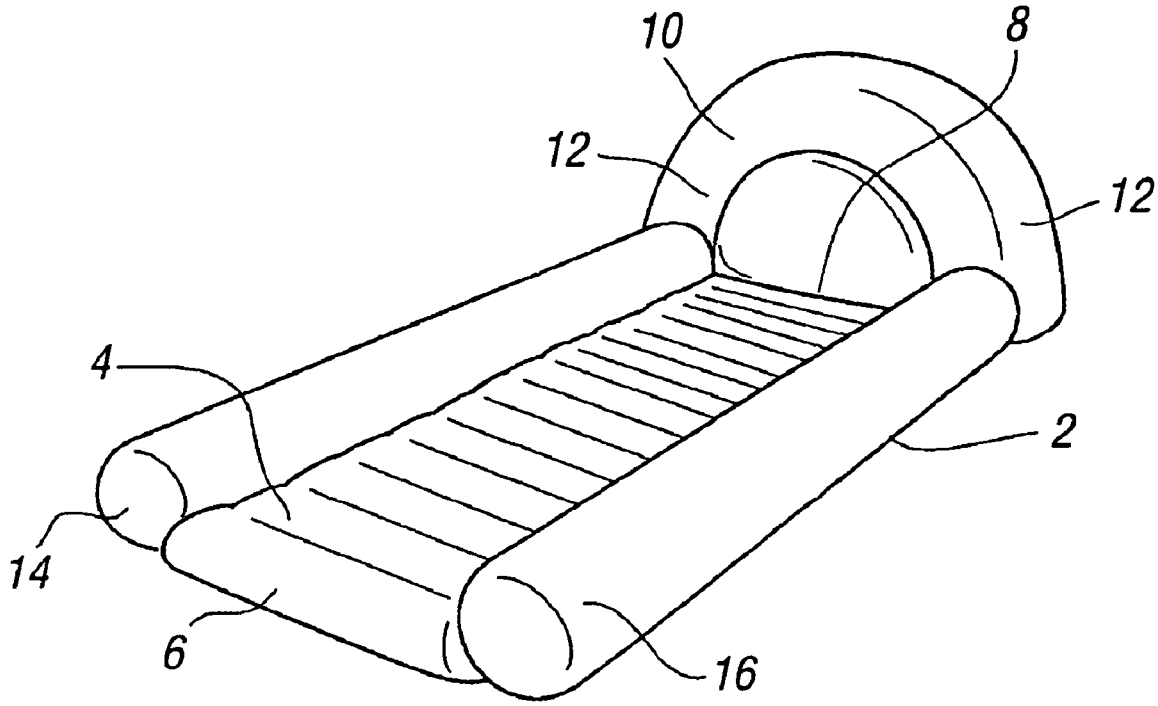

The apparatus which is the subject of this application relates to a sleepy and/or sitting apparatus in the form of, for example, mattress surface with support surrounds so as to maintain the person, such as although not exclusively, a baby, toddler or infant, in position on the apparatus thereby preventing or minimising the possibility of the person leaving the apparatus and perhaps causing injury to themselves.

The applicant is the proprietor of granted patents and co-pending patent applications which relate to the provision of a mattress which is movable between a storage, deflated condition and in use, inflated condition. In the in use condition, the mattress is provided with a pillow section which is raised in comparison to the rest of the top surface of the mattress so as to provide added comfort to the user of the same. These mattresses are designed for use by children or adults and are not specifically intended for use by younger children such as infants or toddlers.

The aim of the present invention is to provide an apparatus, for infants and toddlers in particular, which provides additional security and/or safety for the same. However, it should be appreciated that the apparatus in the form that will now be described, may be used by older children or adults by producing apparatus of a suitable scale.

In a first aspect of the invention there is provided support apparatus for a person, said apparatus including an inflatable mattress section on which the person can lie and, at on least one end of said mattress section and depending upwardly there from, there is provided an inflatable section.

Typically, the inflatable section depends upwardly in a substantially vertical plane substantially perpendicular to the plane of the mattress and can act as a headboard or footboard, or if two are provided, a headboard and footboard are provided.

In one embodiment, the inflatable section is formed by a series of semicircular or semi spherical air pockets. Typically, the air pockets are interconnected and the headboard section is inconnected with the cavity or cavities of the mattress section.

In one embodiment, all of the inflatable cavities within the apparatus are inflatable via the connection of an air supply to a single valve or multiple valves.

In one embodiment, the inflatable cavities which make up the mattress section are arranged to lie in parallel with the longitudinal axis of the mattress section. In an alternative embodiment, the cavities lie transverse or perpendicular to the longitudinal access of the mattress.

In a further embodiment, the apparatus includes first and second support portions, each of said support portions arranged along a side edge of the mattress section. Typically, each of said support portions is inflatable to an extent such that the same has a height greater than that of the mattress section when inflated. Thus, it will be appreciated that the support portions are provided to prevent a young child, lying on the mattress, from rolling off the mattress as the support portions, with the greater height, act to turn the child back onto the mattress.

In one embodiment, the support apparatus further includes a mat which can be laid onto the mattress section and it is on that which the person rests. This mat section may be simply of a sheet material or alternatively can include padding and/or may be inflatable.

In whichever form, it is preferred that the mat section is shaped such that at least the underside of the same, which lies on the mattress, is shaped such that the underside has a profile which matches that of the inflatable cavities of the mattress section when inflated. In addition to making the mat fit better onto the mattress, this also allows improved location of the mat on the inflatable mattress. In one embodiment, the top side of the mattress is substantially planer and may therefore provide a more comfortable surface on which to lie.

The provision of the inflatable section which is upstanding as herein described, firstly, provides the means for preventing the person from sliding or moving off the top or bottom of the mattress section and also provides a support against which a pillow may be placed thereby providing greater comfort to the person sleeping on the mattress and in particular to an infant or child. Furthermore, in one embodiment, the inflatable portion may be of sufficient height so as to allow the same to be used as the back of a chair thereby allowing the person in the apparatus to sit up and be supportive in a sitting position by the upstanding section.

Figure 1B:
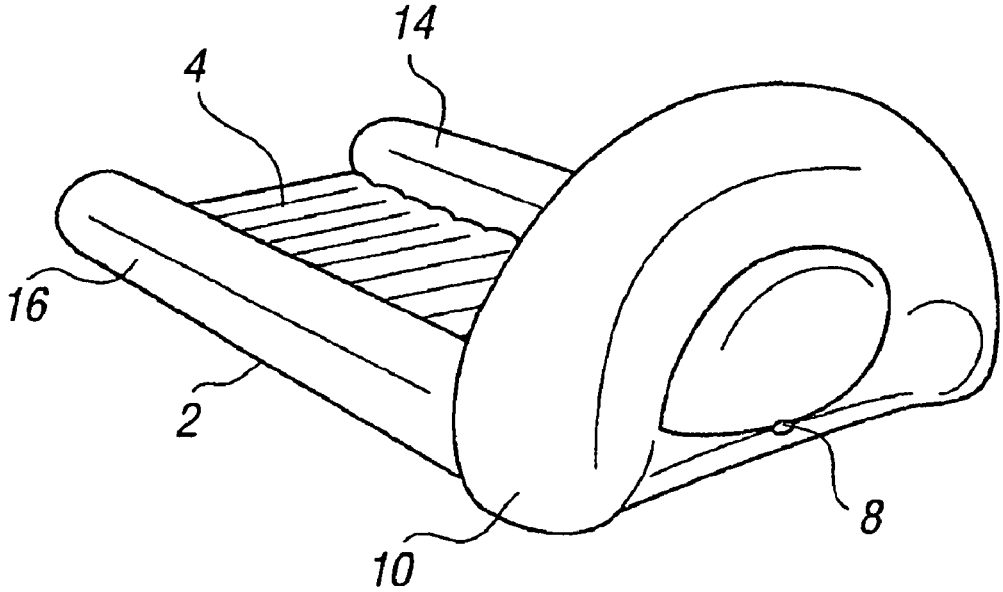
Figure 2A:
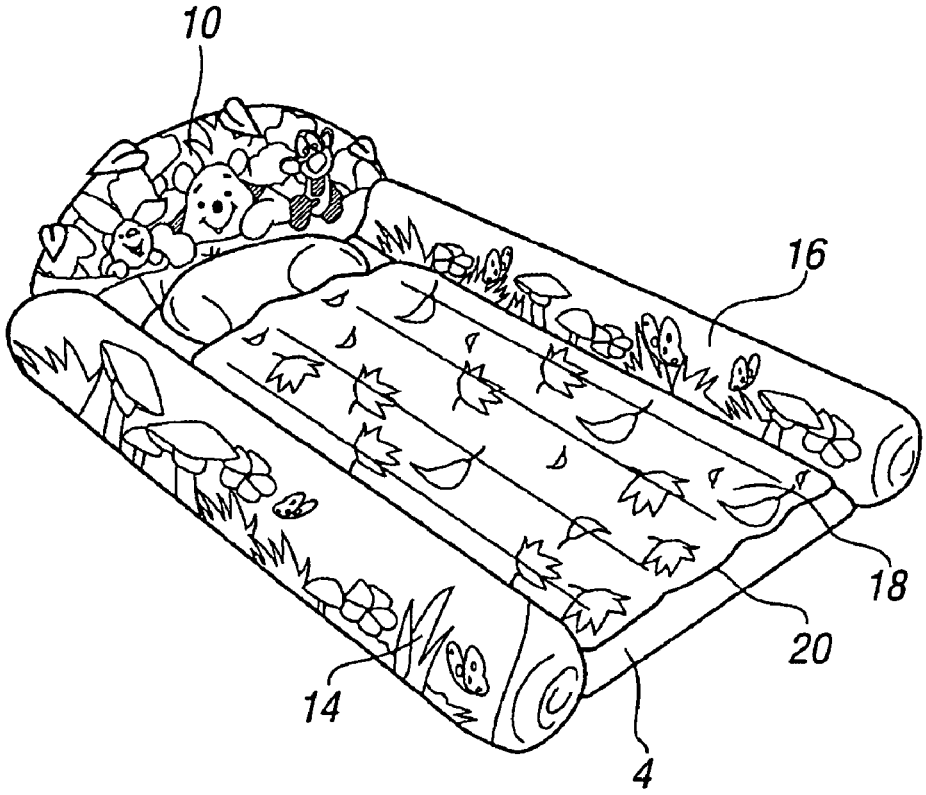
Figure 2B:
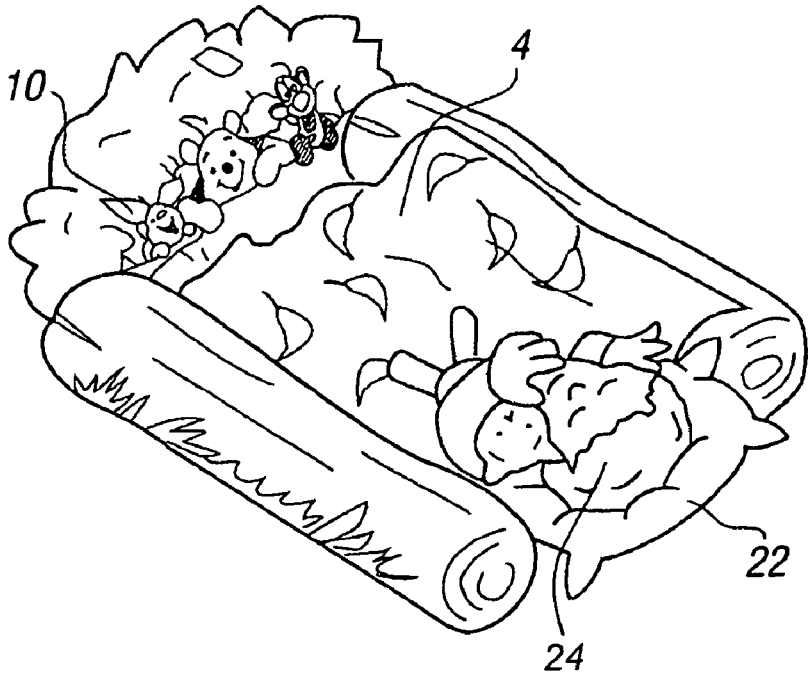

Specific embodiments of the invention are now described with reference to the accompanying drawings wherein FIGS. 1*a–b* illustrates a first embodiment of the invention; and FIG. 2*a–b* illustrate a further embodiment of the invention.

Referring firstly to FIG. 1*a–b* there is illustrated support apparatus 2 in accordance with the first embodiment of the invention, said support apparatus comprising an inflatable mattress section 4 which is formed of a series of inflatable cavities or air tubes 6. Typically, the cavities are interconnected to allow the inflation of the same via a single valve located at 8 in FIG. 1*b* or via a number of valves which could be of any suitable format but preferably will allow relevantly quick inflation and deflation. At one end, typically the end of which the user's head is placed in use, there is a provided an inflatable section 10, said section formed from a series of cavities 12 which are preferably interconnected with the inflatable cavities 6 of the mattress section 4. As shown, the inflatable section 10 depends upwardly from the mattress section 4 and substantially perpendicular thereto.

Depending along each side of the inflatable mattress section are inflatable support portions 14, 16. These support portions, when inflated as shown, are of a greater height than the top surface of the inflatable mattress and thereby act as means to prevent the person on the mattress section from easily rolling out of the mattress section to either side as the support portions, if contacted by the person, act to roll the person back onto the main mattress section.

FIGS. 2*a–b* illustrate a further embodiment of the invention wherein the same reference numbers are used to describe the same components. In this embodiment, there is also provided a mat 18 which is provided to overlie the mattress section 4 when inflated, as shown. The mat portion includes an underside 20 which is shaped so as to take the form of the top surface of the mattress. This acts to locate the mat in position on the mattress section. The mat acts as a protection for the mattress and can also be padded or inflatable itself so as to provide a more comfortable surface on which the person can lie. This arrangement is particularly attractive for use with young children and the mat can act as a changing mat, for example, on which the child can be placed before they are able to walk so as to allow the child to be securely located in position on the apparatus on the mattress section while lying within the area provided, and the support portions 14, 16 act as barriers in conjunction with the inflatable section 10, to allow the child to be retained in position and makes it difficult for the young child to crawl out of same.

The FIG. 2*b* also shows how the apparatus can be used with the person's head 24 at the far end 22 of the mattress 4 as opposed to adjacent the inflatable section 10. It is also apparent how the outer surface of the apparatus can be printed and/or covered to provide a particular visual effect.

The invention claimed is:

1. A support apparatus for a person, the apparatus comprising:

an inflatable mattress section on which the person can lie;

an inflatable section depending from at least one end of die mattress section in a substantially vertical upward plane that is substantially perpendicular to the plane of the mattress section, the inflatable section comprising a series of air pockets, the air pockets being in the shape of a semi-circular vertical arch or semi-spherical, whereby the inflatable section functions as a headboard or a footboard.

2. The support apparatus of claim 1, wherein the air pockets are interconnected.

3. The support apparatus of claim 2, wherein the air pockets are interconnected with a cavity of the inflatable mattress section.

4. The support apparatus of claim 1, wherein the inflatable mattress section and the inflatable section are inflated by means of the connection of an air supply to at least one valve.

5. The support apparatus of claim 1, wherein the inflatable mattress section comprises at least two inflatable cavities.

6. The support apparatus of claim 5, wherein the at least two inflatable cavities are arranged to lie parallel to the longitudinal axis of the inflatable mattress section.

7. The support apparatus of claim 5, wherein the at least two inflatable cavities are arranged to lie perpendicular to the longitudinal axis of the inflatable mattress section.

8. The support apparatus of claim 1, further comprising first and second support portions arranged along first and second side edges, respectively, of the inflatable mattress section.

9. The support apparatus of claim 8, wherein the first and second support portions are inflatable.

10. The support apparatus of claim 9, wherein the first and second support portions, when in an inflated position, have a height that is greater than that of the inflatable mattress section.

11. The support apparatus of claim 1, wherein the inflatable section extends upwardly to a height that is sufficient for supporting the back of a person who is sitting on the inflatable mattress section.

12. The support apparatus of claim 1, wherein the inflatable mattress section has a top surface on which the person can lie, the top surface having a rib-like profile, and wherein the support apparatus includes a mat to be laid over the top surface of the inflatable mattress section, the mat having an underside shaped to complement the rib-like profile of the top surface of the inflatable mattress section, whereby the mat is easily fit and located on the inflatable mattress section.

13. A support apparatus for a person, the apparatus comprising:

an inflatable mattress section having a top surface on which the person can lie, the top surface having a rib-like profile;

an inflatable section depending upwardly from at least one end of the mattress section; and a mat to be laid over the top surface of the inflatable mattress section, the mat having an underside shaped to complement the rib-like profile of the top surface of the inflatable mattress section, whereby the mat is easily fit and located on the inflatable mattress section.

14. A support apparatus of claim 13, wherein the mat is padded.

15. A support apparatus of claim 13, wherein the mat is inflatable.

16. A support apparatus of claim 13, wherein the mat has a top side that is substantially planar.

* * * * *